US007444094B2

(12) United States Patent
Narita et al.

(10) Patent No.: US 7,444,094 B2
(45) Date of Patent: Oct. 28, 2008

(54) IMAGE FORMING DEVICE AND METHOD CAPABLE OF HIGH QUALITY DUPLEX PRINTING

(75) Inventors: Shoko Narita, Ebina (JP); Takashi Kokubu, Ebina (JP); Masaaki Nishi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/006,742

(22) Filed: Dec. 8, 2004

(65) Prior Publication Data

US 2005/0249516 A1 Nov. 10, 2005

(30) Foreign Application Priority Data

May 7, 2004 (JP) ..... 2004-138153

(51) Int. Cl.
*G03G 15/00* (2006.01)

(52) U.S. Cl. ..... 399/82; 399/51

(58) Field of Classification Search ..... 399/82
See application file for complete search history.

(56) References Cited

U.S. PATENT DOCUMENTS 5,504,568 A * 4/1996 Saraswat et al. ..... 399/364
5,557,367 A * 9/1996 Yang et al. ..... 399/364
5,729,790 A * 3/1998 Conley et al. ..... 399/77
5,812,273 A * 9/1998 Conley et al. ..... 399/364
6,097,500 A * 8/2000 Fromherz ..... 399/364

FOREIGN PATENT DOCUMENTS

JP 10-202978 A 8/1998

* cited by examiner

*Primary Examiner*—David M. Gray
*Assistant Examiner*—Ryan D Walsh
(74) *Attorney, Agent, or Firm*—Oliff & Berridge, PLC

(57) ABSTRACT

An image forming device and method in which, when double-sided printing is carried out, placing an image of a first side and an image of a second side at a position determined in accordance with the position of the image of the first side; if it is judged a predetermined interval or more is needed between the respective placed images and images which have already been placed and are adjacent to the placed images, and judged that the predetermined interval or more is not maintained between them, placing again the images of the first and second sides at positions where the predetermined interval is maintained, are performed, is provided.

20 Claims, 5 Drawing Sheets

IMAGE FORMING DEVICE AND METHOD CAPABLE OF HIGH QUALITY DUPLEX PRINTING

CROSS-REFERENCE TO RELATED APPLICATION

This application claims priority under 35 USC 119 from Japanese Patent Application No. 2004-138153 the disclosures of which are incorporated by reference herein.

BACKGROUND OF THE INVENTION

1. Field of the Invention

The present invention relates to an image forming device and method which form images corresponding to image data on recording sheets in accordance with an electrophotographic process. In particular, the present invention relates to an image forming device and method at which continuous double-sided printing is possible.

2. Description of the Related Art

Image forming devices using an electrophotographic process are generally used in image formation at printers, copiers, or fax machines which form images on recording sheets, or multi-function devices which combine the functions of the aforementioned devices, or the like. In an image forming device, a toner image is formed by developing, using toner, an electrostatic latent image formed on a photosensitive drum. Thereafter, in the image forming device, the toner image is transferred to a recording sheet, and thereafter, the toner image is fixed to the recording sheet by being heated while pressure is applied to the toner image together with the recording sheet by using fixing rollers.

Such an image forming device is provided with developing units corresponding of the respective colors of C (cyan), M (magenta), Y (yellow), and K (black). At each of the developing units, a photosensitive drum is provided. The photosensitive drum is exposed such that a latent image is formed thereon, and thereafter, toner images are formed by carrying out toner development using toners of the respective colors.

Among image forming devices, there are those which are provided with an intermediate transfer body such as an intermediate transfer belt or the like. The toner images of the respective colors which are formed on the photosensitive drums are transferred in a superposed manner onto the intermediate transfer body such that a color toner image is formed. Thereafter, by transferring the toner image which is on the intermediate transfer body onto a recording sheet, a color image using toners of the respective colors of C, M, Y, K is formed on the recording sheet.

Such an image forming device can carry out so-called double-sided printing in which images are formed on the both surfaces (Side 1 and Side 2) of a single recording sheet. An image forming device which can carry out double sided printing is provided with a reversing section which switches the conveying direction of a recording sheet at which the image of Side 1 has been formed, and a circulating conveying path which returns the recording sheet, at which the image of Side 1 has been formed, to the sheet feeding side of an image forming section. Image formation on Side 2 is thereby possible.

There are image forming devices which, in order to be able to form images on a large number of recording sheets in a short period of time, continuously convey the recording sheets at predetermined pitches, and form images on the intermediate transfer body in accordance with the conveying pitches of the recording sheets.

In such an image forming device, when double-sided printing is carried out continuously onto a large number of recording sheets, for example, the images of Side 1 are formed onto a predetermined number of the recording sheets respectively, and when the recording sheets on which these images of Side 1 have been formed are returned to the sheet feeding side, they are placed between recording sheets on which images of Side 1 are to newly be formed, such that image formation at Side 1 and image formation at Side 2 are carried out in parallel. The produceability is thereby improved.

At this time, the order of forming the toner images is set in advance in accordance with the order of the sheets being fed to the image forming section (i.e., scheduling is carried out), such that the formation of the toner images is carried out in the set order.

Namely, at the time of carrying-out single-sided printing, as shown in FIG. 5A, scheduling is carried out so as to place, in order, an image P1 to be formed to a first recording sheet, an image P2 to be formed on a second recording sheet, an image P3 to be formed on a third recording sheet, . . . . In contrast, when double-sided printing is carried out, as shown in FIG. 5B, scheduling is carried out with a "pitch skip" being provided.

For example, FIG. 5B illustrates a case in which image formation of Side 2 is carried out, at a timing corresponding to six pitch skips, after image formation of Side 1. Namely, in this case, regions corresponding to six images (six sides of recording sheets) are provided between image P1*a* formed on Side 1 of the first recording sheet and image P1*b* formed on Side 2 of the first recording sheet. In this case, a region corresponding to one image is skipped (i.e., one pitch skip is provided) between image P1*a* formed on Side 1 of the first recording sheet and image P2*a* formed on Side 1 of the second recording sheet. Further, image P1*b* formed on Side 2 of the first recording sheet is placed between image P4*a* formed on Side 1 of the fourth recording sheet and image P5*a* formed on Side 1 of the fifth recording sheet.

Double-sided printing can be carried out efficiently by scheduling in this way.

On the other hand, there are image forming devices which switch on and off motors (DeveMotors) used in rotation of photosensitive drums, when a single-color image using K or the like for example and a full color image using the four colors of C, M, Y, K are formed.

When on/off switching of a DeveMotor or the like arises when forming single-color images and full-color images in this way, the recording sheets are apt to become foggy or dirtied by toner. In order to prevent this, scheduling is carried out so as to insert pitch skip(s) and change the intervals at which the images are placed. Further, in cases in which one pitch skip (a region corresponding to one image) is insufficient (FIG. 5C), scheduling must be carried out so as to insert two pitch skips (regions corresponding to two images).

Namely, as shown in FIG. 5D, if the images P1, P2 formed on the first and second recording sheets are single-colored K images and the image P3 formed on the third recording sheet is a full-color (four-color) image (or in the opposite case), scheduling is carried out so as to skip regions corresponding to two images (insert two pitch skips) between the image P2 and the image P3.

However, as shown in FIG. 5B, when double-sided printing is carried out, the position of the image of Side 2 is already determined when the image of Side 1 is formed. Thus, when, for example, two pitch skips must be provided in order to switch between a single-color image and a color image, if the image P1*b* to be formed on Side 2 of the first recording sheet is a single-color image and an image P2*b* of Side 2 of the second recording sheet is a color image, a predetermined pitch skip cannot be provided between the images P1*b*, P2*b*.

SUMMARY OF THE INVENTION

The present invention is developed in view of the aforementioned, and provides an image forming device and method in which, even when executing print jobs in which both single-color images and color images are mixed together, high-quality images can be formed while suppressing a deterioration in produceability.

A first aspect of the present invention is an image forming device including: an image forming section that forms an image on a recording sheet; and a setting section that sets an image forming order and image forming intervals when double-sided printing is carried out in which images are formed on first sides and second sides of a plurality of recording sheets, the image forming section carrying out image formation in the set image forming order while conveying the recording sheets on the basis of the image forming intervals set by the setting section, wherein, the setting section carries out: placing images to be formed on the first sides of the recording sheets at predetermined positions in the order of image formation onto the recording sheets, and images to be formed on the second sides of the recording sheets at positions determined in accordance with the positions where the images of the first sides are placed, judging whether or not a predetermined interval or more is needed between the respective placed images and images which have already been placed and are adjacent to the placed images; if it is judged that the predetermined interval or more is needed, confirming whether or not the predetermined interval or more is maintained; and if it is judged that the predetermined interval or more is not maintained, placing again the image of the first side and the image of the second side at positions where the predetermined interval is maintained.

A second aspect of the present invention is an image forming device including: an image forming section that forms an image on a recording sheet; and a setting section that sets an image forming order and image forming intervals when double-sided printing is carried out in which images are formed on first sides and second sides of a plurality of recording sheets, the image forming section carrying out image formation in the set image forming order while conveying the recording sheets on the basis of the image forming intervals set by the setting section, wherein, when the setting section places images to be formed on the first sides of the recording sheets at positions in the order of image formation onto the recording sheets, the positions, where the images to be formed on the first sides of the recording sheets can be placed, being set in advance, and images to be formed on the second sides of the recording sheets at positions determined in accordance with the positions where the images of the first sides are placed, the setting section carries out: temporarily placing an image of the first side; temporarily placing an image of the second side at a position determined in accordance with the position of the image of the first side; judging whether or not a predetermined interval or more is needed between the respective temporarily placed images and images which have already been placed and are adjacent to the temporarily placed images; if it is judged that the predetermined interval or more is needed, confirming whether or not the predetermined interval or more is maintained; if it is judged that the predetermined interval or more is not maintained, temporarily placing again the image of the first side and the image of the second side; and if it is judged that the predetermined interval or more is not needed or if it is judged that the predetermined interval or more is maintained, setting the temporary placement positions as placement positions of the image of the first side and the image of the second side.

A third aspect of the invention is an image forming method including: setting an image forming order and image forming intervals when double-sided printing is carried out in which images are formed on first sides and second sides of a plurality of recording sheets; placing images to be formed on the first sides of the recording sheets at positions in the order of image formation onto the recording sheets, and images to be formed on the second sides of the recording sheets at positions determined in accordance with the positions where the images of the first sides are placed, judging whether or not a predetermined interval or more is needed between the respective placed images and images which have already been placed and are adjacent to the placed images; if it is judged that the predetermined interval or more is needed, confirming whether or not the predetermined interval or more is maintained; if it is judged that the predetermined interval or more is not maintained, placing again the image of the first side and the image of the second side at positions where the predetermined interval is maintained; and carrying out image formation in the set image forming order while conveying the recording sheets on the basis of the set image forming intervals.

A fourth aspect of the present invention is an image forming method including: setting an image forming order and image forming intervals when double-sided printing is carried out in which images are formed on first sides and second sides of a plurality of recording sheets; and carrying out image formation in the set image forming order while conveying the recording sheets on the basis of the set image forming intervals, wherein, when placing images to be formed on the first sides of the recording sheets at positions in the order of image formation onto the recording sheets, the positions, where the images to be formed on the first sides of the recording sheets can be placed, being set in advance, and images to be formed on the second sides of the recording sheets at positions determined in accordance with the positions where the images of the first sides are placed, temporarily placing an image of the first side; temporarily placing an image of the second side at a position determined in accordance with the position of the image of the first side; judging whether or not a predetermined interval or more is needed between the respective temporarily placed images and images which have already been placed and are adjacent to the temporarily placed images; if it is judged that the predetermined interval or more is needed, confirming whether or not the predetermined interval or more is maintained; if it is judged that the predetermined interval or more is not maintained, temporarily placing again the image of the first side and the image of the second side; and if it is judged that the predetermined interval or more is not needed or if it is judged that the predetermined interval or more is maintained, setting the temporary placement positions as placement positions of the image of the first side and the image of the second side, are carried out.

In the aspects of the invention, first, the images to be formed on the first side and the second side of the first recording sheet are placed. Thereafter, the images of the first sides and the images of the second sides to be formed on the recording sheets from the second recording sheet are placed in order.

At this time, it is confirmed whether or not there is the need to provide, for example, a pitch skip(s) between the images which are placed at this time and the images which have already been placed. If there is the need to provide a pitch skip, it is confirmed whether or not a predetermined pitch skip is provided. If the predetermined pitch skip is not provided, regardless of need for the provision thereof, the image of the first side is again placed. On the basis of the image position of the first side which has been placed again, the image of the second side is again placed. Thereafter, the appropriateness of these new placement positions is confirmed.

Further, in the other aspects of the invention, first, the images to be formed on the first side and the second side of the first recording sheet are temporarily placed, and these temporary placement positions are set as the placement positions of these images. Thereafter, the images of the first sides and the images of the second sides to be formed on the recording sheets from the second recording sheet are temporarily placed in order, and the placement positions of the respective images are set in the order of temporary placement.

At this time, it is confirmed whether or not there is the need to provide, for example, a pitch skip(s) between the images which are temporarily placed and the images which have already been placed. If there is the need to provide a pitch skip, it is confirmed whether or not a predetermined pitch skip is provided. If the predetermined pitch skip is not provided, regardless of need for the provision thereof, the image of the first side is again temporarily placed. On the basis of the image position of the first side which has been temporarily placed again, the image of the second side is again temporarily placed. Thereafter, the appropriateness of these new temporary placement positions is confirmed.

By carrying out scheduling in which the image positions are placed in order in this way, the respective images can be placed at appropriate intervals and in an appropriate order. Therefore, high-quality images can be formed while a deterioration in produceability is suppressed.

As described above, in accordance with the aspects of the present invention, when double-sided printing is carried out continuously onto plural recording sheets, even if, for example, pages of black-and-white images and pages including color images are mixed together, scheduling can be carried out appropriately on the intermediate transfer body such as a transfer belt or the like. Therefore, there is the excellent effect that high-quality images can be formed.

BRIEF DESCRIPTION OF THE DRAWINGS

Embodiments of the invention will be described in detail with reference to the following figures, wherein:

FIG. 5A shows a case of single-sided printing, FIG. 5B shows a case of double-sided printing, FIG. 5C shows a case of one pitch skip, and FIG. 5D shows a case of two pitch skips.

DETAILED DESCRIPTION OF THE INVENTION

Figure 1:
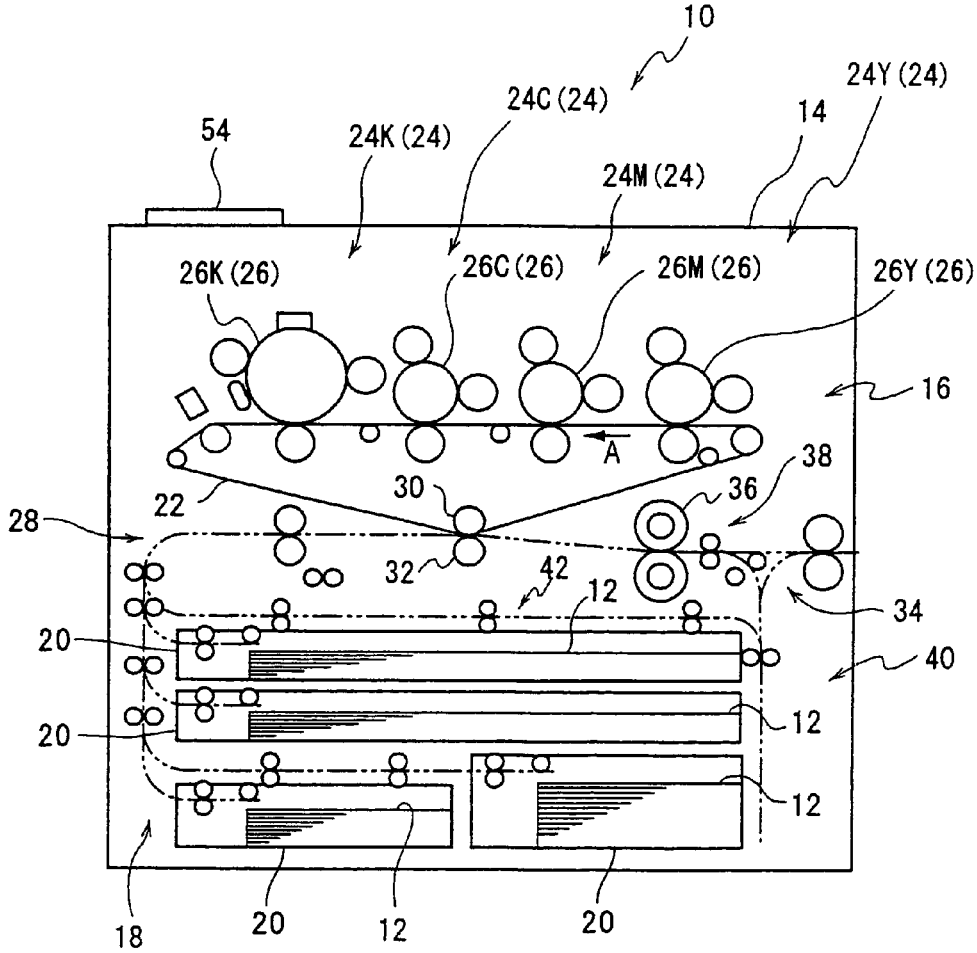
FIG. 1 is a schematic structural diagram of an image forming device applied to the present embodiment.

An embodiment of the present invention will be described hereinafter with reference to the drawings. The schematic structure of an image forming device 10 of the present embodiment is shown in FIG. 1. The image forming device 10 utilizes recording sheets 12 for image formation, and forms thereon images by an electrophotographic process system while conveying the recording sheets 12.

The image forming device 10 has a printer function of forming, on the recording sheets 12, images corresponding to image data which is inputted as print jobs from a personal computer, a work station, or the like. In addition, the image forming device 10 can be applied to a copier, a fax machine, a multifunction device which combines the functions thereof, or the like.

The image forming device 10 can be used in a state in which an additional tray which accommodates a large number of the recording sheets 12 and which can supply the recording sheets 12 to the image forming device 10, a finisher which has various types of after-processing functions such as preparing of booklets, folding in two, Z-folding, stapling, punching, and the like, or the like is connected to the image forming device 10.

As shown in FIG. 1, an image forming section 16, which forms images on the recording sheets 12 in accordance with an electrophotographic process, and a sheet feeding section 18, in which are loaded the recording sheets 12 which are to be supplied (fed) to the image forming section 16, are provided at the image forming device 10. Plural sheet feed trays 20, which respectively accommodate a large number of the recording sheets 12 in a stacked manner, are provided in the sheet feeding section 18. In the sheet feeding section 18, the recording sheets 12 are pulled from the topmost layer of the sheet feed tray 20.

A conveying path 28, which conveys the recording sheets 12 from the sheet feeding section 18 toward predetermined positions of the image forming section 16, is formed in the image forming device 10. The recording sheets 12 which are pulled from the sheet feed tray 20 are conveyed and supplied (fed) to the image forming section 16 along the conveying path 28.

The image forming section 16 forms toner images by an electrophotographic process. An endless transfer belt 22 serving as an intermediate transfer body is provided in the image forming section 16. The transfer belt 22 is driven to rotate in the direction of arrow A in FIG. 1. Developing modules 24 are disposed in the image forming section 16 so as to oppose the transfer belt 22. The image forming device 10 can form full-color images by using toners of the respective colors of Y (yellow), M (magenta), C (cyan), and K (black). Developing modules 24Y, 24M, 24C, 24K, which correspond to the respective colors of Y, M, C, K, are provided in the image forming section 16 as the developing modules 24.

Photosensitive drums 26 (26Y, 26M, 26C, 26K) are provided at the developing modules 24Y, 24M, 24C, 24K, respectively. A toner image is formed on each of the photosensitive drums 26. Note that the photosensitive drums 26 are, for example, provided at drum cartridges, and can form high-quality toner images by being replaced at predetermined times.

In the image forming section 16, toner images corresponding to the image to be formed on the recording sheet 12 are formed on the photosensitive drums 26. Further, in the image forming section 16, the respective toner images formed on the photosensitive drums 26 are transferred onto the transfer belt 22 in a superposed manner. In this way, a full-color toner image is formed on the transfer belt 22.

A transfer roller 30 and a roller 32 are provided as a pair in the image forming section 16 at the side of the conveying path 28 of the recording sheets 12. The transfer belt 22 is trained around the transfer roller 30, such that the recording sheet 12 is supplied in between the transfer belt 22 and the roller 32.

In the image forming section 16, the recording sheet 12 and the transfer belt 22 are sent to the transfer position between the transfer roller 30 and the roller 32 and are nipped by the transfer roller 30 and the roller 32, such that the recording sheet 12 and the toner image formed on the transfer belt 22 are superposed. In this way, the toner image of the transfer belt 22 is transferred to the recording sheet 12.

A fixing module 38 having a pair of fixing rollers 36 is provided in the image forming section 16. A conveying path 34, which conveys the recording sheet 12 from between the transfer roller 32 and the roller 30 to the exterior of a casing 14 via the fixing module 38, is formed in the image forming device 10.

The recording sheet 12, onto which the toner image has been transferred, is fed into the fixing module 38, and is nipped by the fixing rollers 36. In the fixing module 38, the recording sheet 12 is heated while being pressurized by being nipped by the fixing rollers 36, such that the toner fuses and fixes to the recording sheet 12.

In this way, an image using toners is formed on the recording sheet 12. The recording sheet 12 on which the image is formed is conveyed along the conveying path 34, and is, for example, placed in a stack by being discharged into an unillustrated sheet discharge tray provided at the exterior of the casing 14.

On the other hand, a reversing section 40 is provided in the image forming device 10 at the downstream side of the fixing module 38. The recording sheet 12 which has passed through the fixing module 38 can be made to diverge off from the conveying path 34 and enter into the reversing section 40.

A circulating conveying path 42, which conveys the recording sheet 12 from the reversing section 40 toward the sheet feeding side, is formed between the reversing section 40 and the conveying path 28 at the sheet feeding side. Double-sided printing, in which images are formed on the both sides of the recording sheet 12, is possible in the image forming device 10. When double-sided printing is carried out, the recording sheet 12 which has passed through the fixing module 38 is fed into the reversing section 40. At the reversing section 40, the conveying direction of the recording sheet 12 is reversed, and the recording sheet 12 is fed out to the circulating conveying path 42.

In this way, the recording sheet 12, at which an image has been formed on one surface (Side 1) thereof, is conveyed to the transfer position (between the transfer roller 30 and the roller 32) such that the other surface (Side 2) thereof opposes the transfer belt 22.

Figure 2:
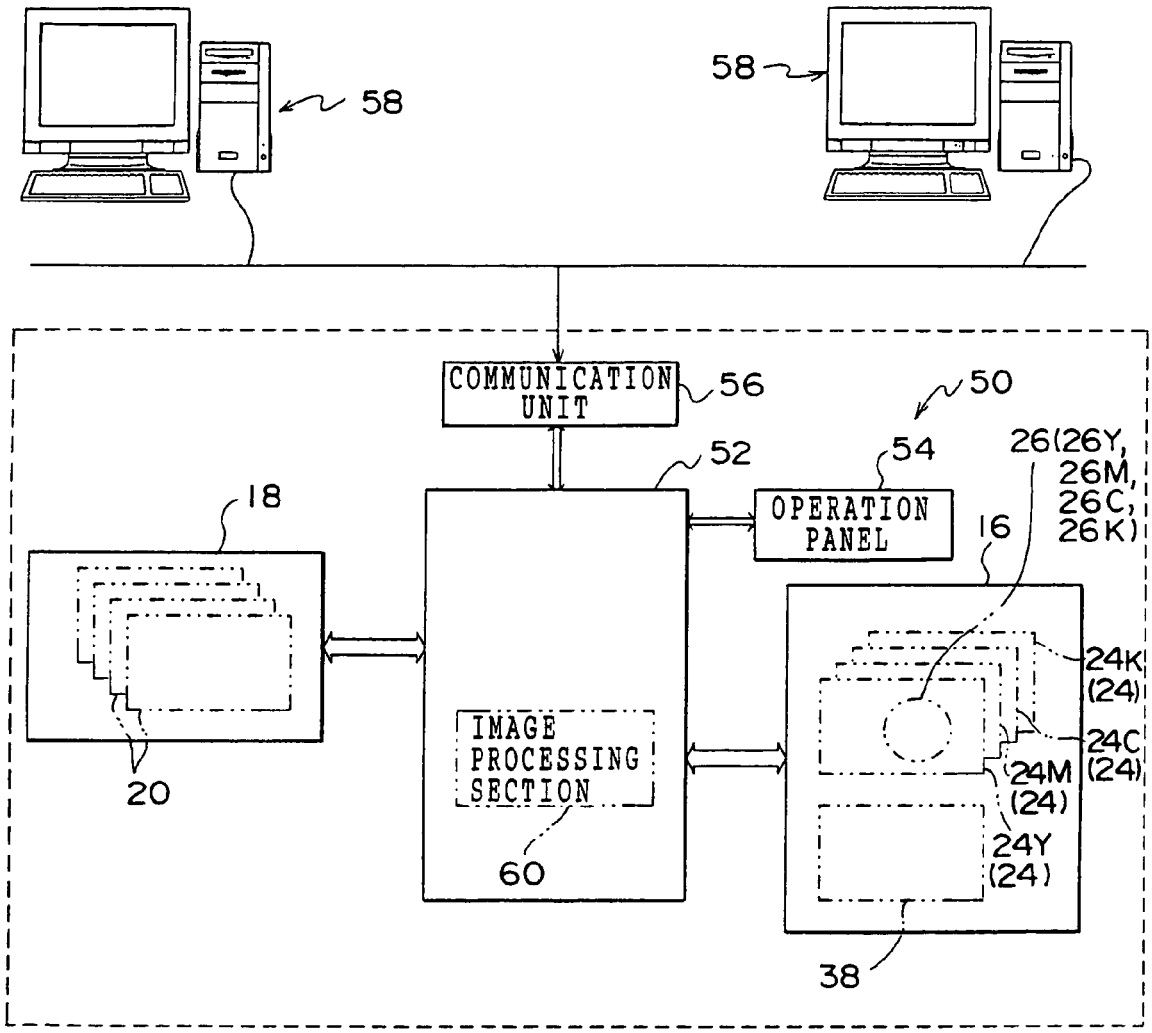
FIG. 2 is a schematic structural diagram of control at the image forming device.

As shown in FIG. 2, a control section 50, which controls the operations of the image forming section 16, the sheet feeding section 18, and the like, is provided at the image forming device 10. The control section 50 has a print controller 52 equipped with a microcomputer (a CPU, not illustrated). The operations of the image forming section 16 and the sheet feeding section 18 and the like, and the conveying of the recording sheets 12 are controlled by the print controller 52.

An operation panel 54 and a communication unit 56 are provided at the control section 50, and are connected to the print controller 52.

As shown in FIG. 1, the operation panel 54 is provided at, for example, a predetermined position of the top surface of the casing 14. The operation panel 54 has a general structure in which it is provided with a display which displays various types of information, and a keyboard used for inputting various types of information based on the display of the display and the like. Various types of setting operations and the like using the operation panel 54 are possible at the image forming device 10. Note that a touch panel, in which a display function and a keyboard function are integrated, or the like can be used as the operation panel 54.

As shown in FIG. 2, the image forming device 10 is network-connected via the communication unit 56 to a large number of image processing terminals 58 such as personal computers or work stations or the like. In this way, a print job, which includes image data forming an image on the recording sheet 12, or the like can be inputted to the image forming device 10 from the image processing terminal 58.

When the print controller 52 receives a print job via the communication unit 56, the print controller 52, on the basis of the received print job, carries out setting of the various types of printing functions, which include the number of sheets to be printed, single-sided printing/double-sided printing, and the like.

An image processing section 60 is provided at the print controller 52. The image processing section 60 carries out various types of image processings on the image data based on the aforementioned settings. Further, the image processing section 60 divides the image data of each page into respective color components of Y, M, C, K, and carries out raster image processing ("RIP") for generating raster data to be used in scanning and exposing the photosensitive drums 26.

The print controller 52 forms a toner image based on the raster data on the recording sheet 12, by controlling the operations of the image forming section 16 while controlling the conveying of the recording sheet 12.

When images are to be formed on a large number of the recording sheets 12 in continuation, the print controller 52 provided at the image forming device 10 carries out scheduling for setting the order of placement and the placement intervals of the toner images (hereinafter simply called "images") on the transfer belt 22. The print controller 52 continuously forms images on the recording sheets 12 by carrying out control of the conveying of the recording sheets 12 and control of the formation of images onto the transfer belt 22 on the basis of the set placement intervals and order.

At this time, the surface of the transfer belt 22 is divided in accordance with, for example, the loop length of the transfer belt 22, the sizes of the recording sheets 12 on which images are to be formed, the conveying speed of the recording sheets 12, the position of the seam of the transfer belt 22 which is a position at which images cannot be formed on the transfer belt 22, and the like, and an image is placed at each divisional position.

For example, by dividing the transfer belt 22 into eight pitches, images of eight sides of the recording sheets 12 can be placed. When images are to be formed continuously onto the recording sheets 12, images are placed in order at these image positions.

Figures 5A, 5B, 5C, 5D:
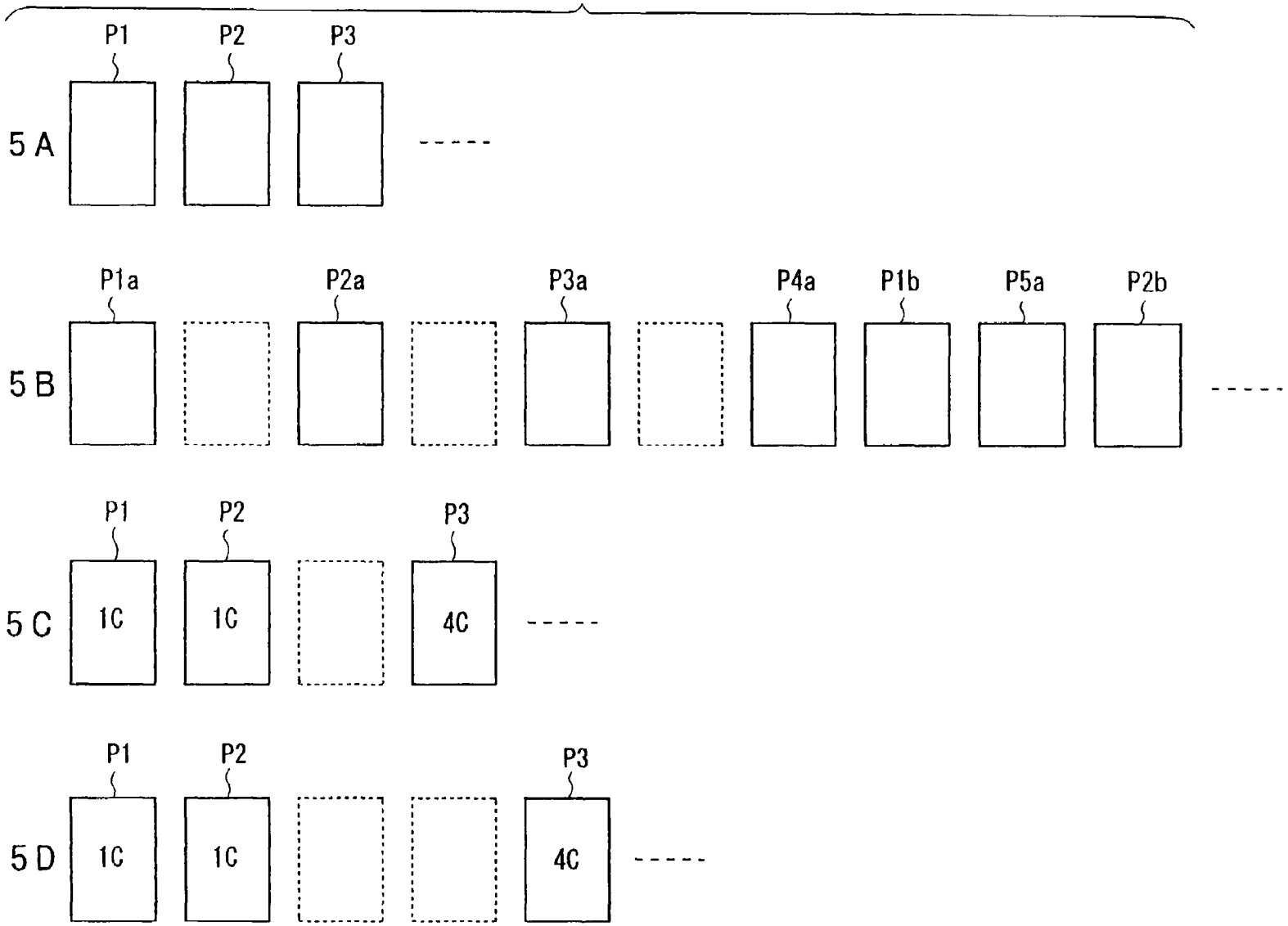
FIGS. 5A through 5D are schematic diagrams respectively showing examples of basic scheduling, where

Namely, as shown in FIG. 5A, an image P1 to be formed on the first recording sheet 12, an image P2 to be formed on the second recording sheet 12, and an image P3 to be formed on the third recording sheet 12, can be placed in order.

On the other hand, double-sided printing can be carried out at the image forming device 10. When executing a print job in which double-sided printing has been designated, as shown in FIG. 5B, the images of Sides 1 of the recording sheets 12 are placed, with a region corresponding to one image being left free (open) between the images of the Sides 1 of the respective recording sheets 12. (Leaving open a region corresponding to one image is called "providing one pitch skip".) In this way, the image of Side 2 of any one of recording sheets 12 can be placed between the images of Sides 1.

Namely, a space corresponding to one image is ensured between an image P1*a* of Side 1 of the first recording sheet 12 and an image P2*a* of Side 1 of the second recording sheet 12.

In the image forming device 10, the recording sheet 12, at which the image of Side 1 has been formed, is returned to midway along the conveying path 28 by using the reversing section 40 and the circulating conveying path 42, and is fed to the transfer position of the image forming section 16. In this way, in the image forming device 10, the recording sheet 12, at which the image of Side 1 has been formed, can be placed between the recording sheets 12 which have been taken-out from the sheet feed tray 20.

Here, in order to form the image of Side 2 at, for example, a timing of six pitch skips after formation of the image of Side 1, scheduling is carried out such that when the first recording sheet 12 is returned to the conveying path 28 and reaches the image transfer position, as shown in FIG. 5B, an image P1*b*, which is to be formed on Side 2 of the first recording sheet 12, is placed between an image P4*a* to be formed on Side 1 of the fourth recording sheet 12 and an image P5*a* to be formed on Side 1 of the fifth recording sheet 12.

In this way, the images P1*a*, P1*b* can be formed on the both sides of the first recording sheet 12.

On the other hand, when a full-color image is to be formed at the image forming section 16, image formation is carried out by using the developing modules 24Y, 24M, 24C, 24K. However, when, for example, single-color images, such as black-and-white images, are to be formed over all of the surfaces of the recording sheets 12, there are cases in which the developing modules 24Y, 24M, 24C which are not needed for image creation are stopped from the standpoints of the life of the developer and problems in transfer, and only the developing module 24K is used.

Namely, in the image forming section 16, switching of the rotating/stopping of the photosensitive drum 26 of the developing module 24 (on/off of the DeveMotor) and the like arise in accordance with the image to be formed on the recording sheet 12 (hereinafter, this will be referred to as "switching of the developing module 24").

In the image forming device 10, in a case in which switching of the developing module 24 from on to off or from off to on cannot be carried out sufficiently during the period of time corresponding to the region between images, if scheduling is carried out such that images are formed on the recording sheets 12 without providing pitch skips, deterioration of the finished quality, such as fogging or dirtying by toner or the like, will arise in the images formed on the recording sheets 12.

Thus, when the print controller 52 carries out scheduling, the print controller 52 confirms whether or not switching of the developing module will arise. If switching of the developing module 24 cannot be carried out sufficiently within a period of time corresponding to the region between images, the print controller 52 carries out scheduling so as to provide a preset pitch skip such as a one pitch skip or a two pitch skip or the like (i.e., so as to leave blank a region corresponding to one image or two images), so as to prevent a deterioration in the finished quality.

For example, when setting is carried out so as to provide a one pitch skip at the time when switching of the developing module 24 is carried out, if the switching of the developing module 24 will arise between the image P2 to be formed on the second recording sheet 12 and the image P3 to be formed on the third recording sheet 12, scheduling is carried out so as to provide one pitch skip between the image P2 and the image P3 as shown in FIG. 5C.

When setting is carried out so as to provide a two pitch skip at the time when switching of the developing module 24 is carried out, scheduling is carried out so as to provide the two pitch skip between the image P2 and the image P3 as shown in FIG. 5D. Note that, in FIGS. 5C and 5D, "1C" denotes a single-color image, and "4C" denotes a four-color (full-color) image.

Also when double-sided printing is carried out, the print controller 52 carries out scheduling while providing a predetermined pitch skip at the time when switching of the developing module 24 is to arise.

Namely, the print controller 52 carries out scheduling of the image P1*a* of Side 1 and the image P1*b* of Side 2 of the first recording sheet 12, and next, temporarily places the image P2*a* to be formed on Side 1 and image P2*b* to be formed on Side 2 of the second recording sheet 12. The print controller 52 confirms whether or not switching of the developing module 24 is to arise between, on the one hand, the image P1*a* of Side 1 and the image P1*b* of Side 2 of the first recording sheet 12 which have already been placed, and, on the other hand, the image P2*a* to be formed on Side 1 and the image P2*b* to be formed on Side 2 of the second recording sheet 12 (i.e., between adjacent images). If switching is to arise, the print controller 52 confirms whether or not a predetermined pitch skip is ensured.

At this time, regardless of switching of the developing module 24 will arise, if a predetermined pitch skip is not ensured, the image P2*a* of Side 1 is temporarily placed at a next position at which placement of the Side 1 image is possible, and the image P2*b* is temporarily placed at a position corresponding to the position of this image P2*a*, and it is again confirmed whether or not a predetermined pitch skip is ensured. When a predetermined pitch skip is ensured, scheduling is carried out such that the images P2*a*, P2*b* are placed at those positions.

By repeating these operations in order at the print controller 52, scheduling which ensures a predetermined pitch skip is carried out, and at the same time, processing for forming images onto the recording sheets 12 on the basis of this scheduling is executed.

When the image forming device 10 which is structured in this way receives a print job outputted from the image processing terminal 58, the image forming device 10 carries out setting of the printing functions on the basis of the settings of the print job. Thereafter, on the basis of the print settings, the sheet feed tray 20 from which is to be pulled the recording sheet 12 on which an image is to be formed is selected, and image processing and RIP processing based on the image data are executed.

Thereafter, at the image forming device 10, the recording sheet 12 is pulled from the selected sheet feed tray 20, and the pulled recording sheet 12 is conveyed (fed). On the basis of the raster data, the photosensitive drums 26 are scanned and exposed so that electrostatic latent images are formed thereon, and toner images are formed by toner development.

Further, at the image forming device 10, after the toner images have been transferred onto the transfer belt 22 and the image has been transferred from the transfer belt 22 onto the recording sheet 12, the image is fixed on the recording sheet 12 by the fixing module 38. The recording sheet 12, on which an image based on the print job has been formed, is thereby obtained.

On the other hand, when images are to be formed continuously onto the recording sheets 12, the print controller 52 provided at the image forming device 10 carries out scheduling of the images to be formed on the recording sheets 12, and carries out conveying of the recording sheets 12 and image formation on the basis of the scheduling. High produceability is thereby ensured.

At the image forming device 10, at times such as when, for example, a single-color image is to be formed from full-color image formation or a full-color image is to be formed from a single-color image or the like, switching of the developing module 24 (e.g., turning the DeveMotor from on to off, or from off to on, or the like) is carried out.

At this time, when the print controller 52 carries out scheduling which ensures a predetermined pitch skip, it is possible to form high-quality images in which no fogging or toner dirtying or the like arises, while suppressing a deterioration in produceability.

Double-sided printing, in which images are formed on both sides of the recording sheet 12, is possible at the image forming device 10. Due to the print controller 52 carrying out scheduling to ensure a predetermined pitch skip at the time when double-sided printing is carried out continuously onto the recording sheets 12, formation of high-quality images is possible while a deterioration in produceability is suppressed.

Here, the scheduling at the time when double-sided printing is carried out will be described with reference to FIG. 3 and FIGS. 4A through 4E. This flowchart is executed when the print controller 52 receives a print job at which double-sided printing is set, and images based on this print job are to be formed. FIGS. 4A through 4E show the state of progression of the scheduling in that order. Hereinafter, explanation will be given in accordance with the flowchart of FIG. 3, and reference will be made as needed to FIGS. 4A through 4E.

Moreover, in the following explanation, as an example, the image P2*b* to be formed on Side 2 of the second recording sheet 12 and an image P3*b* to be formed on Side 2 of the third recording sheet 12 are full-color (4C) images, and other images are black-and-white (1C) images. Scheduling is carried out such that a two pitch skip is provided when switching of the developing module 24 occurs.

Figure 3:
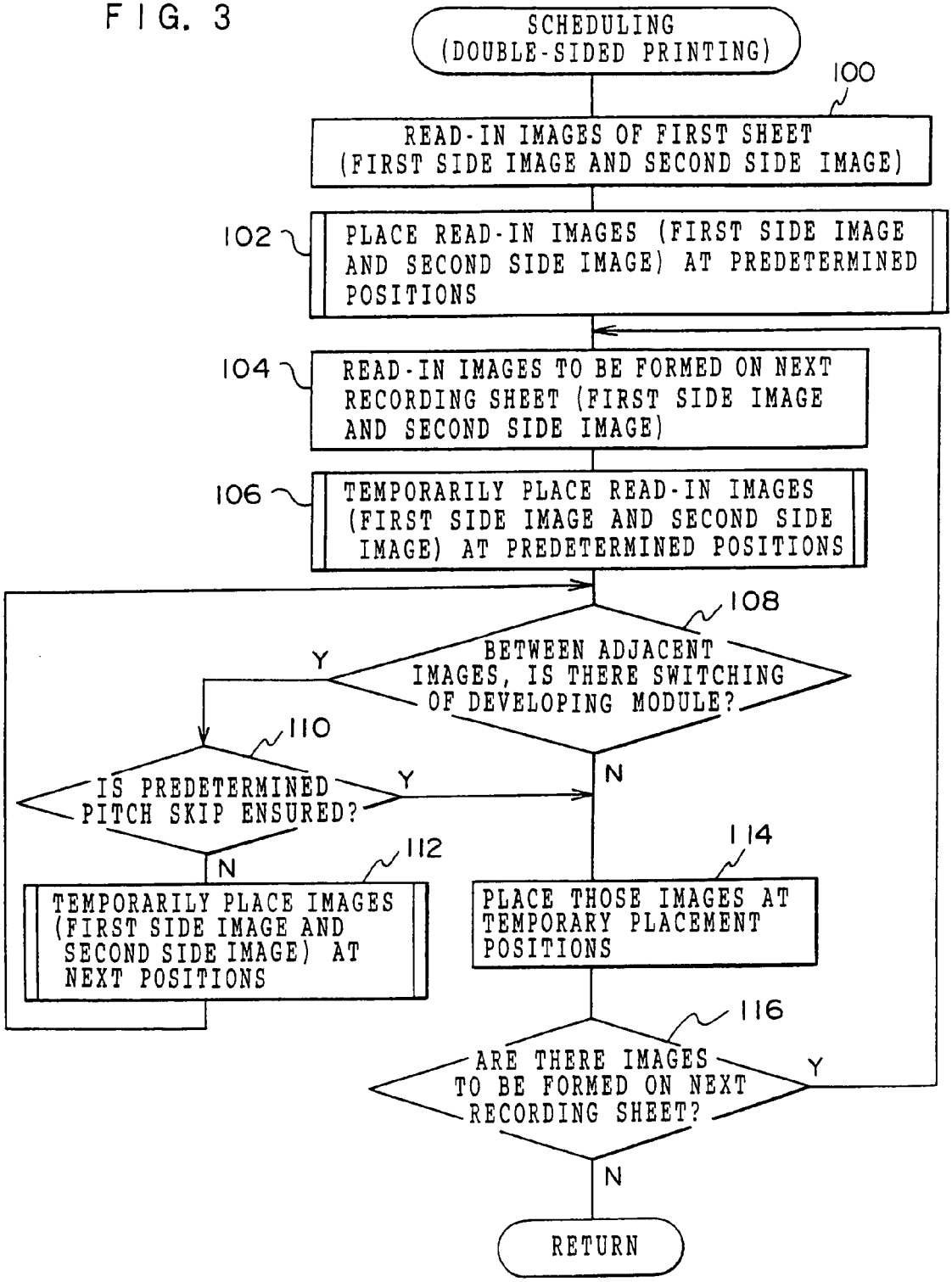
FIG. 3 is a flowchart showing a summary of scheduling processing when double-sided printing is carried out.

In the flowchart of FIG. 3, first, in initial step 100, the image P1*a* of Side 1 and the image P1*b* of Side 2 to be formed on the first recording sheet 12 are read-in. In next step 102, the read-in image P1*a* and image P1*b* are placed at predetermined positions (scheduling is carried out).

Figures 4A, 4B, 4C, 4D, 4E:
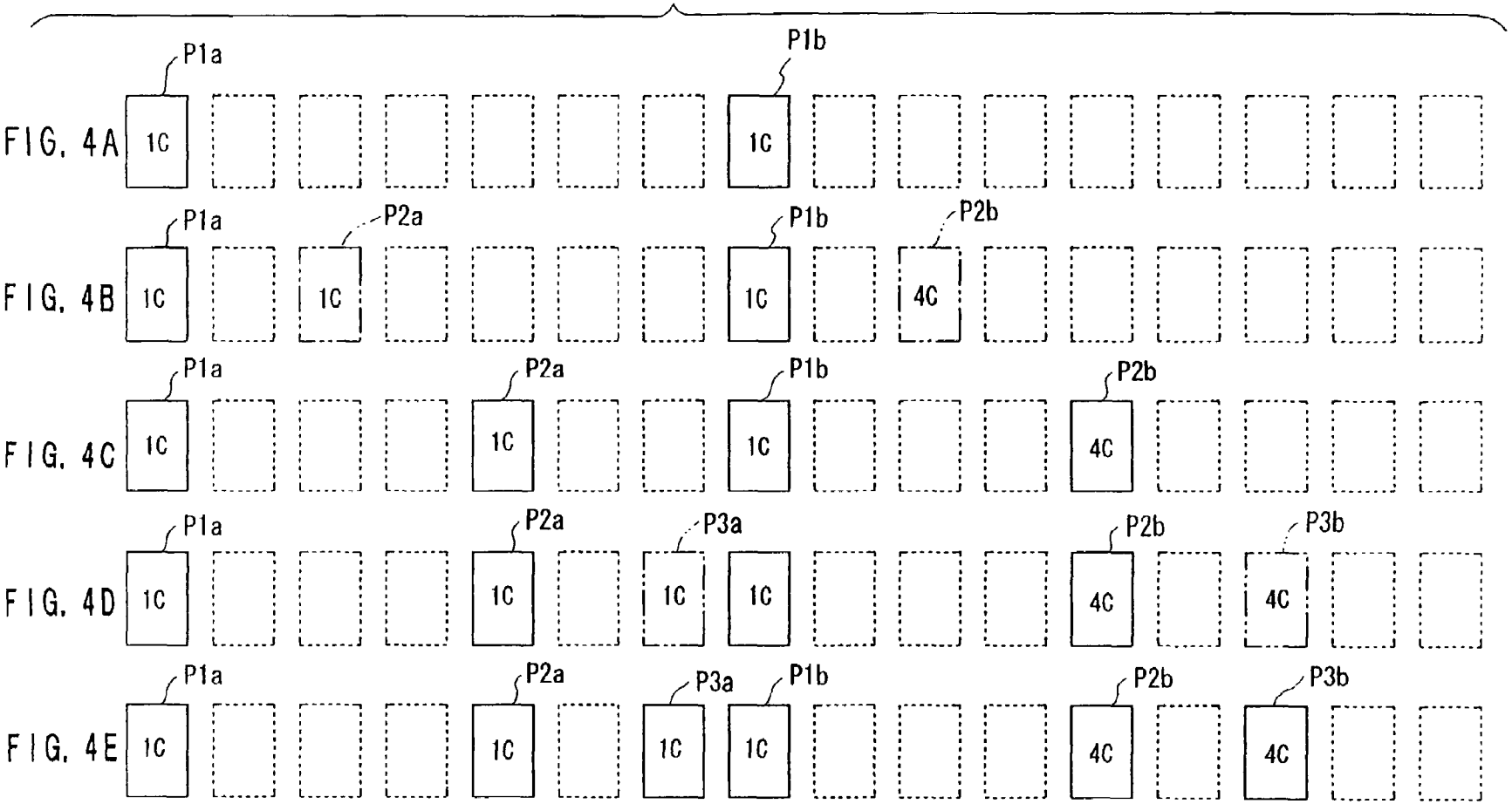
FIGS. 4A through 4E are schematic diagrams showing, in that order, the progression of scheduling in accordance with the flowchart of FIG. 3.

In the image forming device 10, the images of Sides 1 are placed at the odd-numbered positions, and the images of Sides 2 are placed in accordance with the image positions of Sides 1. Here, in the image forming device 10, the images of Sides 2 are placed at the even-numbered positions. In this way, the images P1*a*, P1*b* are placed as shown in FIG. 4A.

Thereafter, in step 104, the images to be formed on the next recording sheet 12 are read-in. At this time, if the images to be formed on the next recording sheet 12 are images to be formed on the second recording sheet 12, the image P2*a* to be formed on Side 1 of the second recording sheet 12 and the image P2*b* to be formed on Side 2 of the second recording sheet 12 are read-in.

In subsequent step 106, the read-in images are temporarily placed at predetermined positions. In this way, as shown in FIG. 4B, the image P2*a* is temporarily placed after the image P1*a* with an interval of a region corresponding to one image therebetween, and the image P2*b* of Side 2 is temporarily placed on the basis of the position of the image P2*a*.

In next step 108, it is confirmed whether or not switching of the developing module 24 will arise between the respective temporarily placed images (the image P2*a* and the image P2*b*) and the respective images which have already been placed (the image P1*a* and the image P1*b*) (i.e., between adjacent images).

Here, because the image P1*a* and the image P2*a* are both black-and-white images, switching of the developing module 24 between the image P1*a* and the image P2*a* does not occur. However, because the image P1*b* is a black-and-white image whereas the image P2*b* is a full-color image, switching of the developing module 24 will arise between the image P1*b* and the image P2*b*.

In this way, in the flowchart of FIG. 3, the determination in step 108 is affirmative, and the routine moves on to step 110. In step 110, it is confirmed whether or not a predetermined pitch skip is ensured between the images at which the switching of the developing module 24 will take place (the image P1*b* and the image P2*b*).

At this time, as shown in FIG. 4B, because two pitch skips are not provided between the image P1*b* and the image P2*b*, in the flowchart in FIG. 3, the determination in step 110 is negative, and the routine moves on to step 112.

In step 112, the image P2*a*, which previously was temporarily placed, is again temporarily placed at the next position at which placement is possible, and the image P2*b* is temporarily placed in accordance with the position of placement of the image P2*a*. In this way, as shown in FIG. 4C, in the state in which the images P1*a*, P2*a* have been placed, the images P2*a*, P2*b* are again temporarily placed.

In this way, when the re-placement is completed, the routine returns to step 108 where it is confirmed whether or not the placement positions are appropriate.

At this time, switching of the developing module 24 will arise between the temporarily placed image P2*b* and the image P1*b* which has already been placed, but a pitch skips of 2 or more are ensured. In this way, in the flowchart of FIG. 3, the determination in step 110 is affirmative, and the routine moves on to step 114.

In step 114, those images (the images P2*a*, P2*b*) are formally placed at the positions where they were temporarily placed. In this way, in the images to be formed on the first and second recording sheets 12 are scheduled (see FIG. 4C).

In the preceding explanation, both the image P2*a* of Side 1 and the image P2*b* of Side 2 are temporarily placed, and it is confirmed whether or not the respective positions of placement thereof are appropriate. However, for example, the image P2*a* of Side 1 may first be temporarily placed, and it can be confirmed whether this position of temporary placement is appropriate. If appropriate, this temporary placement position can be temporarily set as the placement position of the image P2*a* of Side 1. On the basis of this temporarily set position, the temporary placement of the image P2*b* of Side 2 can be carried out, and it can be judged whether or not this temporary placement position of the image P2*b* is appropriate.

At this time, if the position of the image P2*b* of Side 2 is appropriate, the image P2*a* of Side 1 and the image P2*b* of Side 2 are set as placement positions thereof. If they are not appropriate, setting may be carried out again from the temporary placement of the position of the image P2*a* of Side 1.

In this way, when the positions of the image P2*a* to be formed on Side 1 and the image P2*b* to be formed on Side 2 of the second recording sheet 12 are set, in step 116, it is confirmed whether or not there are images to be formed on the next recording sheet 12. When scheduling of images to be formed on the third recording sheet 12 (images P3*a*, P3*b*) is to be carried out, the determination in step 116 is affirmative, and the routine moves on to step 104.

Namely, scheduling, from the first recording sheet 12 to the third recording sheet 12, of the images of Side 1 and the images of Side 2 is carried out in order.

In this way, in step 104, the images to be formed on the next recording sheet 12 (the images P3*a*, P3*b*) are read-in, and in step 106, temporary placement of the read-in images is carried out. In this way, as shown in FIG. 4D, the images P3*a*, P3*b* are temporarily placed in the state in which the images P1*a*, P1*b*, P2*a*, P2*b* have been scheduled.

Here, there is no switching of the developing module 24 between the image P3*a* and the adjacent images P2*a* and P1*b*. Further, although the image P3*b* is a full-color image, the image P2*b* adjacent the image P3*b* is also a full-color image. Therefore, there is no switching of the developing module 24 between the image P2*b* and the image P3*b*.

In this way, in the flowchart of FIG. 3, the determination in step 108 is negative, and the routine moves on to step 114, and scheduling is carried out by placing the images P3*a*, P3*b* at the temporary placement positions (see FIG. 4E).

While the print controller 52 is carrying out scheduling in this way, printing processing is executed at a predetermined timing.

In this way, the print controller 52 can carry out scheduling while ensuring appropriate pitch skips, at the time when double-sided printing, in which pages of black-and-white images and pages including full-color images are mixed together, is carried out.

The image forming device 10 can thereby form high-quality images in which there is no fogging or toner dirtying, while suppressing a deterioration in produceability.

Note that, in the present embodiment, description is given of carrying out scheduling by providing two pitch skips at the time when switching of the developing module 24 will occur. However, the image forming device can be applied also in cases in which a one pitch skip or three pitch skips or more is provided.

In the present embodiment, black-and-white images and full-color images are described as examples. However, the present invention can be applied to scheduling which is carried out when switching of an arbitrary developing module 24 arises, such as between images where switching of any one of the developing modules 24Y, 24M, 24C, 24K will occur such as between a single-color image of one of C, M, Y, K and a full-color image, or the like.

Moreover, in the present embodiment, explanation is given of a case in which the present invention is applied to the image forming device 10. However, the present invention is not limited to the same, and may be applied to an image forming device of an arbitrary structure which forms images on the recording sheets 12 by an electrophotographic process.

In the aspects, after the setting section judges whether or not the placement position of the image of the first side is appropriate and sets the placement position, the setting section may judge whether or not the placement position of the image of the second side, which is determined in accordance with the position where the image of the first side is placed, is appropriate.

In this case, the image of the first side is placed, and setting is carried out by judging the appropriateness of the placement position. Thereafter, the image of the second side is placed at position which is determined on the basis of the set position where the image of the first side is placed, and the appropriateness of the placement position is judged.

At this time, regardless of that the placement position of the image of the second side is a position requiring the provision of a pitch skip, if the predetermined pitch skip is not provided, it suffices to again shift the position of the image of the first side to a position where placement is possible in order and carry out setting.

Further, it is possible that the image forming section includes a plurality of developing sections corresponding to a plurality of colors, and when use of at least one of the plurality of developing sections is changed at a period of time between formation of the respective placed images and formation of the images which have already been placed and are adjacent to the placed images, it is judged that the predetermined interval or more is needed.

Further, it is possible that the plurality of developing sections correspond to colors of C, M, Y, K, respectively.

Further, it is possible that, when it is judged that the predetermined interval or more is not maintained, the setting section places again the image of the first side at a next position where images of the first sides can be placed, and the image of the second side at a position determined in accordance with the position of the image of the first side which is placed again.

Further, it is possible that the predetermined interval corresponds to a time required when changing of use of the at least one of the plurality of developing sections.

Further, it is possible that the setting section carries out: placing an image of the first side of a first recording sheet; placing an image of the second side of the first recording sheet; placing an image of the first side of a second recording sheet; placing an image of the second side of the second recording sheet; judging whether or not the predetermined interval or more is needed between the image of the first side of the first recording sheet and the placed image of the first side of the second recording sheet, or between the image of the second side of the first recording sheet and the placed image of the second side of the second recording sheet; if it is judged that the predetermined interval or more is needed, confirming whether or not the predetermined interval or more is maintained; and if it is judged that the predetermined interval or more is not maintained, placing again the image of the first side of the second recording sheet and the image of the second side of the second recording sheet.

Further, it is possible that the image forming section comprises a plurality of developing sections corresponding to a plurality of colors, and when use of at least one of the plurality of developing sections is changed at a period of time between formation of the image of the first side of the first recording sheet and formation of the placed image of the first side of the second recording sheet, or between formation of the image of the second side of the first recording sheet and formation of the placed image of the second side of the second recording sheet, it is judged that the predetermined interval or more is needed.

What is claimed is:

1. An image forming device comprising:

an image forming section that forms an image on a recording sheet, the image forming section comprising a plurality of developing sections corresponding to a plurality of colors; and a setting section that sets an image forming order and image forming intervals when double-sided printing is carried out in which images are formed on first sides and second sides of a plurality of recording sheets, the image forming section carrying out image formation in the set image forming order while conveying the recording sheets on the basis of the image forming intervals set by the setting section, wherein, the setting section is adapted to place first images to be formed on the first sides of the recording sheets at predetermined positions in the order of image formation onto the recording sheets, and second images to be formed on the second sides of the recording sheets at positions determined in accordance with the positions where the first images of the first sides are placed, the setting section is adapted to judge whether or not a predetermined interval or more is needed between the respective placed first and second images and images which have already been placed and are adjacent to the placed first and second images, the setting section judging that the predetermined interval or more is needed between one of the placed first and second images and an image that has already been placed and is adjacent to the one of the placed first and second images when a configuration of at least one of the developing sections is changed from a configuration for multi-color image formation to a configuration for single-color image formation or from a configuration for single-color image formation to a configuration for multi-color image formation during the time period between the time of formation of the one of the placed first and second images and the time of formation of the image that has already been placed and is adjacent to the one of the placed first and second images, the setting section is adapted to confirm whether or not the predetermined interval or more is maintained when it is judged that the predetermined interval or more is needed; and the setting section is adapted to place again a first image of a first side and a second image of a second side at positions where the predetermined interval is maintained when it is judged that the predetermined interval or more is not maintained.

2. The image forming device of claim 1, wherein, after the setting section judges whether or not the placement position of the first image of the first side is appropriate and sets the placement position, the setting section judges whether or not the placement position of the second image of the second side, which is determined in accordance with the position where the first image of the first side is placed, is appropriate.

3. The image forming device of claim 1, wherein the plurality of developing sections correspond to colors of C, M, Y, K, respectively.

4. The image forming device of claim 1, wherein, when it is judged that the predetermined interval or more is not maintained, the setting section places again the first image of the first side at a next position where images of the first sides can be placed, and the second image of the second side at a position determined in accordance with the position of the first image of the first side which is placed again.

5. The image forming device of claim 1, wherein the predetermined interval corresponds to a time required when changing of use of the at least one of the plurality of developing sections.

6. The image forming device of claim 1, wherein the setting section carries out:

placing a first image of the first side of a first recording sheet;

placing a second image of the second side of the first recording sheet;

placing a first image of the first side of a second recording sheet;

placing a second image of the second side of the second recording sheet;

judging whether or not the predetermined interval or more is needed between the first image of the first side of the first recording sheet and the placed first image of the first side of the second recording sheet, or between the second image of the second side of the first recording sheet and the placed second image of the second side of the second recording sheet;

if it is judged that the predetermined interval or more is needed, confirming whether or not the predetermined interval or more is maintained; and if it is judged that the predetermined interval or more is not maintained, placing again the first image of the first side of the second recording sheet and the second image of the second side of the second recording sheet.

7. The image forming device of claim 6, wherein the image forming section comprises a plurality of developing sections corresponding to a plurality of colors, and when use of at least one of the plurality of developing sections is changed at a period of time between formation of the first image of the first side of the first recording sheet and formation of the placed first image of the first side of the second recording sheet, or between formation of the second image of the second side of the first recording sheet and formation of the placed second image of the second side of the second recording sheet, it is judged that the predetermined interval or more is needed.

8. The image forming device of claim 1, the predetermined interval consisting of blank pitches, wherein if it is determined that the predetermined interval or more is needed, the predetermined interval or more of blank pitches is maintained between the placed again first image and the placed again second image.

9. An image forming method comprising:

setting an image forming order and image forming intervals when double-sided printing is carried out in which images are formed on first sides and second sides of a plurality of recording sheets;

placing first images to be formed on the first sides of the recording sheets at positions in the order of image formation onto the recording sheets, and second images to be formed on the second sides of the recording sheets at positions determined in accordance with the positions where the images of the first sides are placed;

judging whether or not a predetermined interval or more is needed between the respective placed first and second images and images which have already been placed and are adjacent to the placed first and second images, wherein it is judged that a predetermined interval or more is needed between one of the placed first and second images and an image that has already been placed and is adjacent to the one of the placed first and second images when a configuration of at least one of a plurality of developing sections is changed from a configuration for multi-color image formation to a configuration for single-color image formation or from a configuration for single-color image formation to a configuration for multi-color image formation during the time period between the time of formation of the one of the placed first and second images and the time of formation of the image that has already been placed and is adjacent to the one of the placed first and second images;

if it is judged that the predetermined interval or more is needed, confirming whether or not the predetermined interval or more is maintained;

if it is judged that the predetermined interval or more is not maintained, placing again a first image of the first side and a second image of the second side at positions where the predetermined interval is maintained; and carrying out image formation in the set image forming order while conveying the recording sheets on the basis of the set image forming intervals.

10. The image forming method of claim 9, wherein, after judging whether or not the placement position of the first image of the first side is appropriate and setting the placement position, it is judges whether or not the placement position of the second image of the second side, which is determined in accordance with the position where the first image of the first side is placed, is appropriate.

11. The image forming method of claim 9, wherein the plurality of developing sections correspond to colors of C, M, Y, K, respectively.

12. The image forming method of claim 9, wherein, when it is judged that the predetermined interval or more is not maintained, the first image of the first side is placed again at a next position where images of the first sides can be placed, and the second image of the second side is placed again at a position determined in accordance with the position of the first image of the first side which is placed again.

13. The image forming method of claim 9, wherein the predetermined interval corresponds to a time required when changing of use of the at least one of the plurality of developing sections.

14. The image forming method of claim 9, wherein placing a first image of the first side of a first recording sheet;

placing a second image of the second side of the first recording sheet;

placing a first image of the first side of a second recording sheet;

placing a second image of the second side of the second recording sheet;

judging whether or not the predetermined interval or more is needed between the first image of the first side of the first recording sheet and the placed first image of the first side of the second recording sheet, or between the second image of the second side of the first recording sheet and the placed second image of the second side of the second recording sheet;

if it is judged that the predetermined interval or more is needed, confirming whether or not the predetermined interval or more is maintained; and if it is judged that the predetermined interval or more is not maintained, placing again the first image of the first side of the second recording sheet and the second image of the second side of the second recording sheet, are carried out.

15. The image forming method of claim 14, wherein the image formation is carried out by using a plurality of developing sections corresponding to a plurality of colors, and when use of at least one of the plurality of developing sections is changed at a period of time between formation of the first image of the first side of the first recording sheet and formation of the placed first image of the first side of the second recording sheet, or between formation of the second image of the second side of the first recording sheet and formation of the placed second image of the second side of the second recording sheet, it is judged that the predetermined interval or more is needed.

16. The image forming method of claim 9, the predetermined interval consisting of blank pitches, wherein if it is determined that the predetermined interval or more is needed, the predetermined interval or more of blank pitches is maintained between the placed again first image and the placed again second image.

17. An image forming device comprising:

an image forming section that forms an image on a recording sheet, the image forming section comprising a plurality of developing sections corresponding to a plurality of colors; and a setting section that sets an image forming order and image forming intervals when double-sided printing is carried out in which images are formed on first sides and second sides of a plurality of recording sheets, the image forming section carrying out image formation in the set image forming order while conveying the recording sheets on the basis of the image forming intervals set by the setting section, wherein, the setting section is adapted to form first images on the first sides of the recording sheets at positions in the order of image formation onto the recording sheets, the positions, where the first images to be formed on the first sides of the recording sheets can be placed, being set in advance, and form second images on the second sides of the recording sheets at positions determined in accordance with the positions where the second images of the first sides are placed, the setting section is further adapted to temporarily place a first image of the first side;

temporarily place a second image of the second side at a position determined in accordance with the position of the first image of the first side;

judge whether or not a predetermined interval or more is needed between the respective temporarily placed first and second images and images which have already been placed and are adjacent to the temporarily placed first and second images;

the setting section judging that a predetermined interval or more is needed between one of the temporarily placed first and second images and an image that has already been temporarily placed and is adjacent to the one of the temporarily placed images when a configuration of at least one of the developing sections is changed from a configuration for multi-color image formation to a configuration for single-color image formation or from a configuration for single-color image formation to a configuration for multi-color image formation during the time period between the time of formation of the one of the temporarily placed first and second images and the time of formation of the image that has already been temporarily placed and is adjacent to the one of the temporarily placed first and second images;

confirm whether or not the predetermined interval or more is maintained if it is judged that the predetermined interval or more is needed;

temporarily place again a first image of the first side and a second image of the second side if it is judged that the predetermined interval or more is not maintained; and set the temporary placement positions as placement positions of the first image of the first side and the second image of the second side if it is judged that the predetermined interval or more is not needed or if it is judged that the predetermined interval or more is maintained.

18. The image forming device of claim 17, the predetermined interval consisting of blank pitches, wherein if it is determined that the predetermined interval or more is needed, the predetermined interval or more of blank pitches is maintained between the first image and the second image.

19. An image forming method comprising:

setting an image forming order and image forming intervals when double-sided printing is carried out in which images are formed on first sides and second sides of a plurality of recording sheets; and carrying out image formation in the set image forming order while conveying the recording sheets on the basis of the set image forming intervals, wherein, when placing first images to be formed on the first sides of the recording sheets at positions in the order of image formation onto the recording sheets, the positions, where the first images to be formed on the first sides of the recording sheets can be placed, being set in advance, and second images to be formed on the second sides of the recording sheets at positions determined in accordance with the positions where the first images of the first sides are placed, temporarily placing a first image of the first side;

temporarily placing a second image of the second side at a position determined in accordance with the position of the image of the first side;

judging whether or not a predetermined interval or more is needed between the respective temporarily placed first and second images and images which have already been placed and are adjacent to the temporarily placed first and second images, wherein it is judged that a predetermined interval or more is needed between one of the temporarily placed first and second images and an image that has already been temporarily placed and is adjacent to the one of the temporarily placed first and second images when a configuration of at least one of a plurality of developing sections is changed from a configuration for multi-color image formation to a configuration for single-color image formation or from a configuration for single-color image formation to a configuration for multi-color image formation during the time period between the time of formation of the one of the temporarily placed first and second images and the time of formation of the image that has already been temporarily placed and is adjacent to the one of the placed first and second images;

if it is judged that the predetermined interval or more is needed, confirming whether or not the predetermined interval or more is maintained;

if it is judged that the predetermined interval or more is not maintained, temporarily placing again the first image of the first side and the second image of the second side; and if it is judged that the predetermined interval or more is not needed or if it is judged that the predetermined interval or more is maintained, setting the temporary placement positions as placement positions of the first image of the first side and the second image of the second side, are carried out.

20. The image forming method of claim 19, the predetermined interval consisting of blank pitches, wherein if it is determined that the predetermined interval or more is needed, the predetermined interval or more of blank pitches is maintained between the first image and the second image.

* * * * *